US005862994A

United States Patent [19]

Pounder et al.

[11] Patent Number: 5,862,994

[45] Date of Patent: Jan. 26, 1999

[54] DEFLECTOR FOR UPRIGHT-TYPE FIRE SPRINKLERS

[75] Inventors: Donald B. Pounder, North Kingstown; Michael A. Fischer, West Kingston, both of R.I.

[73] Assignee: Grinnell Corporation, Cranston, R.I.

[21] Appl. No.: 671,814

[22] Filed: Jun. 25, 1996

[51] Int. Cl.[6] ..... B05B 1/26

[52] U.S. Cl. ..... 239/498; 239/504; 239/518; 169/37

[58] Field of Search ..... 239/498, 504, 239/518, 521, 523, 524; 169/37, 38, 39, 41

[56] References Cited

U.S. PATENT DOCUMENTS

| | | | |
|---|---|---|---|
| 316,581 | 4/1885 | Stratton | 169/37 |
| 849,938 | 4/1907 | Thurlow et al. | 169/39 |
| 965,116 | 7/1910 | Morison | 239/498 |
| 1,115,930 | 11/1914 | Hawkins . | |
| 1,193,619 | 8/1916 | Rowley . | |
| 1,198,397 | 9/1916 | Van Ness . | |
| 1,255,111 | 1/1918 | Buffum . | |
| 1,318,543 | 10/1919 | Clark | 169/39 |
| 1,412,172 | 4/1922 | Duley | 169/39 |
| 2,135,138 | 11/1938 | Kendall | 239/498 |
| 2,697,008 | 12/1954 | Rowley | 169/37 |
| 2,724,614 | 11/1955 | Rider | 169/37 |
| 3,195,647 | 7/1965 | Campbell et al. | 169/37 |
| 3,703,993 | 11/1972 | Schreiner | 239/498 |
| 3,874,455 | 4/1975 | Klesow | 169/37 |
| 3,893,513 | 7/1975 | Marsh | 169/37 |
| 4,014,388 | 3/1977 | Anderson | 169/37 |
| 4,091,873 | 5/1978 | Werner | 169/37 |
| 4,136,740 | 1/1979 | Groos et al. | 169/39 |
| 4,176,718 | 12/1979 | Vorkapich | 169/39 |
| 4,405,018 | 9/1983 | Fischer | 169/37 |
| 4,580,729 | 4/1986 | Pounder | 239/524 |
| 4,585,069 | 4/1986 | Whitaker | 169/37 |
| 4,624,414 | 11/1986 | Ferrazza | 239/524 |
| 4,901,799 | 2/1990 | Pepi et al. | 169/39 |
| 5,036,923 | 8/1991 | Shea, Sr. | 169/37 |
| 5,152,344 | 10/1992 | Fischer et al. | 169/37 |
| 5,366,022 | 11/1994 | Meyer et al. | 169/37 |
| 5,609,211 | 3/1997 | Meyer et al. | 169/37 |

FOREIGN PATENT DOCUMENTS

| | | | |
|---|---|---|---|
| 70430 | 11/1915 | Germany | 239/498 |
| 895460 | 1/1982 | U.S.S.R. | 169/37 |
| 969923 | 9/1964 | United Kingdom | 239/498 |

OTHER PUBLICATIONS

"AquaMiser™ Model B Quick Responses Specific Application Sprinkler," The Viking Corporation, Technical Data Form No. 032990 (May 31, 1991).

(List continued on next page.)

*Primary Examiner*—J. Casimer Jacyna
*Attorney, Agent, or Firm*—Fish & Richardson P.C.

[57] ABSTRACT

An upright-type fire protection sprinkler with a body defining an orifice and outlet for flow of fluid, and a deflector positioned coaxial with the outlet for impingement of fluid flow thereupon, has one or a combination of the following features for improved performance. The deflector may have an inner surface with a recessed central area, and a recessed redirecting area about the central area at a predetermined acute angle and axial offset thereto. The deflector has tines with inner surfaces inclined towards the outlet, at least a first set of tines disposed in planes at about 45° to a first plane of sprinkler frame arms, the surfaces of the first set of tines being inclined at an angle relatively more outward from the axis than the angle of inner surfaces of adjacent tines. The tines may include a second set of tines in a plane perpendicular to the first plane, and a third set of tines in the first plane, inner surfaces of the second set of tines having a second set width and inner surfaces of the third set of tines having a third set width about 0.15 to 0.65 times the second set width. The second set width may be substantially greater than widths of inner surfaces of all other tines.

35 Claims, 7 Drawing Sheets

OTHER PUBLICATIONS

High–Challenge Sprinklers, Application Report: Digital Equipment Corporation, The Viking Corporation, Equipment Application Data, Form No. 2126 10M (May, 1986).
Equipment Application Data, Form No. 2126 10M (May, 1986).
"ESLO Extended Coverage Ordinary Hazard," Central Sprinkler Company, Data Sheet No. 3–4.0 (1995).

Hong–Zen You, Investigation of Spray Patterns of Selected Sprinklers with the FMRC Drop Size Measuring System, *Fire Safety Science*, Proceedings of the First International Symposium (1987).

Grunau Company Inc., 17/32–inch orifice Liquidator sprinklers, Model LD (literature and drawings dated 1973 and 1977) [3 pages].

DEFLECTOR FOR UPRIGHT-TYPE FIRE SPRINKLERS

BACKGROUND OF THE INVENTION

The invention relates to fire protection sprinklers.

An automatic fire sprinkler has a body with an outlet that is normally closed by a plug, the plug being held in place by a heat-activated trigger mechanism, and an orifice which is normally coincident with or just upstream of the outlet.

Automatic sprinklers of the upright type also have a substantially horizontal water distribution deflector that faces the outlet. When a sufficiently elevated temperature is sensed, a thermally responsive element which normally retains the plug in a closed position releases the plug, a vertically directed stream of water (downward for pendent sprinklers and upward for upright sprinklers) discharges from the outlet orifice towards the deflector. The water impacts and is diverted generally radially downward and outward by the deflector, breaking up into a spray pattern, the shape of which is, in large part, a function of the deflector configuration, the water being projected over the intended area of coverage, i.e., the protected area.

SUMMARY OF THE INVENTION

According to one aspect of the invention, an upright fire protection sprinkler comprises a body defining an orifice and outlet for flow of fluid from a source, and a deflector disposed generally coaxial with the outlet and positioned for impingement of the flow of fluid thereupon, the deflector defining an inner surface opposed to water flow from the outlet and an opposite outer surface, the inner surface defining: a central area about the axis, a redirecting area extending about the periphery of the central area at a predetermined acute angle and predetermined axial offset thereto, relative to the horizontal, the redirecting surface being essentially free of through openings from the inner surface of the deflector to the opposite outer surface, and a base area radially outward of the redirecting area, the central area and the redirecting area being recessed from the outlet relative to the base area.

Preferred embodiments of this aspect of the invention may include one or more of the following additional features. The predetermined acute angle is between about 10° to 45°, preferably between about 22° to 32°, and more preferably about 27°. The predetermined axial offset is between about 0.030 inch and 0.210 inch, preferably between about 0.090 inch and 0.150 inch, and more preferably about 0.120 inch. The upright fire protection sprinkler further comprises a pair of frame arms extending from the body and disposed generally in a first plane including the axis, with the deflector mounted thereupon, the deflector further comprising a plurality of tines defining inner tine surfaces inclined towards the outlet. Preferably, the inner tine surfaces of a first set of tines disposed in planes at about 45° to the first plane are inclined at a first predetermined angle which is relatively more outward than a second predetermined angle of adjacent inner tine surfaces. More preferably, the first predetermined angle is between about 10° to 45°, preferably between about 22° to 33°, and more preferably about 27°30', further from the vertical than the second predetermined angle. A second set of tines generally in a plane perpendicular to the first plane have a predetermined second set width and a third set of tines in the first plane including the frame arms has a predetermined third set width, the predetermined third set width being about 0.15 to 0.65 times, preferably about 0.30 to 0.50 times, and more preferably about 0.40 times the predetermined second set width. Preferably, the predetermined second set width is about 0.150 inch and the predetermined third set width is about 0.060 inch. The plurality of tines comprises a second set of tines disposed generally in a plane perpendicular to the first plane, the inner tine surfaces of the second set of tines having a predetermined second set width, the predetermined second width being substantially greater than widths of the inner tine surfaces of all other of the plurality of tines. Preferably, the predetermined second width is about 0.150 inch.

According to another aspect of the invention, an upright fire protection sprinkler comprises: a body defining an orifice and outlet for flow of fluid from a source, a deflector disposed generally coaxial with the outlet and positioned for impingement of the flow of fluid thereupon, and a pair of frame arms extending from the body and disposed generally in a first plane including the axis, with the deflector mounted thereupon, the deflector comprising a plurality of tines defining inner tine surfaces inclined towards the outlet, the plurality of tines comprising a first set of tines disposed in planes at about 45° to the first plane, the inner tine surfaces of the first set of tines being inclined at a first predetermined angle which is relatively more outward from the axis than a second predetermined angle of the inner tine surfaces of adjacent the tines.

Preferred embodiments of this aspect of the invention may include one or more of the following additional features. Preferably, the first predetermined angle is between about 10° to 45°, preferably between about 22° to 33°, and more preferably about 27°30', further from the vertical than the second predetermined angle. The deflector further defines an inner surface opposed to water flow from the outlet and an opposite outer surface, the inner surface defining: a central area about the axis, a redirecting area extending about the periphery of the central area at a predetermined acute angle and predetermined axial offset thereto, relative to the horizontal, the redirecting surface being essentially free of through openings from the inner surface of the deflector to the opposite outer surface, and a base area radially outward of the redirecting area, the central area and the redirecting area being recessed from the outlet relative to the base area.

According to another aspect of the invention, an upright fire protection sprinkler comprises: a body defining an orifice and outlet for flow of fluid from a source, a deflector disposed generally coaxial with the outlet and positioned for impingement of the flow of fluid thereupon, and a pair of frame arms extending from the body and disposed generally in a first plane including the axis, with the deflector mounted thereupon, the deflector comprising a plurality of tines defining inner tine surfaces inclined towards the outlet, the plurality of tines comprising a second set of tines disposed generally in a plane perpendicular to the first plane, and a third set of tines disposed in the first plane including the frame arms, the inner tine surfaces of the second set of tines having a predetermined second set width and the inner tine surfaces of the third set of tines having a predetermined third set width, the predetermined third set width being about 0.15 to 0.65 times the predetermined second set width.

Preferred embodiments of this aspect of the invention may include one or more of the following additional features. The predetermined third set width is preferably about 0.30 to 0.50 times, and more preferably about 0.40 times the predetermined second set width. Preferably, the predetermined second set width is about 0.150 inch and the predetermined third set width is about 0.060 inch. The deflector further defines an inner surface opposed to water flow from the outlet and an opposite outer surface, the inner surface defining: a central area about the axis, a redirecting area extending about the periphery of the central area at a predetermined acute angle and predetermined axial offset thereto, relative to the horizontal, the redirecting surface being essentially free of through openings from the inner surface of the deflector to the opposite outer surface, and a base area radially outward of the redirecting area, the central area and the redirecting area being recessed from the outlet relative to the base area.

According to still another aspect of the invention, an upright fire protection sprinkler comprises: a body defining an orifice and outlet for flow of fluid from a source, a deflector disposed generally coaxial with the outlet and positioned for impingement of the flow of fluid thereupon, and a pair of frame arms extending from the body and disposed generally in a first plane including the axis, with the deflector mounted thereupon, the deflector comprising a plurality of tines defining inner tine surfaces inclined towards the outlet, the plurality of tines comprising a second set of tines disposed generally in a plane perpendicular to the first plane, the inner tine surfaces of the second set of tines having a predetermined second set width, the predetermined second width being substantially greater than widths of the inner tine surfaces of all other of the plurality of tines.

Preferred embodiments of this aspect of the invention may include one or more of the following additional features. The predetermined second width is about 0.150 inch. The deflector further defines an inner surface opposed to water flow from the outlet and an opposite outer surface, the inner surface defining: a central area about the axis, a redirecting area extending about the periphery of the central area at a predetermined acute angle and predetermined axial offset thereto, relative to the horizontal, the redirecting surface being essentially free of through openings from the inner surface of the deflector to the opposite outer surface, and a base area radially outward of the redirecting area, the central area and the redirecting area being recessed from the outlet relative to the base area.

Preferred embodiments of each of the above aspects of the invention may also include one or more of the following additional features. The upright fire protection sprinkler has a K-factor of at least 5.0, preferably at least 7.0, more preferably at least 10.5, and still more preferably at least 13.0.

Within the past three years, the range of available fire protection products for automatic fire sprinkler systems has expanded to include ceiling sprinklers designed to cover larger or "extended coverage" areas when the occupancy being protected falls into the Ordinary Hazard category, as defined by NFPA 13, *Standard for the Installation of Sprinkler Systems*. These sprinklers are referred to as extended coverage/ordinary hazard (ECOH) sprinklers. In order to be acceptable for installation under an installation standard like NFPA 13, automatic fire sprinklers must be included in a list published by an organization acceptable to the local governmental authority having jurisdiction, and meet any additional requirements specified in the installation standard.

Organizations which list ECOH sprinklers include, for example, Underwriters Laboratories Inc. (UL) and Factory Mutual Research Corporation (FM). These types of organizations evaluate the performance of fire protection products, like the ECOH sprinklers, in accordance with established standards or guidelines, to certify that the listed fire protection products will satisfactorily perform their intended function when installed in accordance with the requirements of their listing, the manufacturer's installation instructions, and the installation standards of the authority having jurisdiction.

The standards or guidelines for evaluating ECOH sprinklers include established requirements for the minimum amount of water which must be collected, per unit time, in specified areas (i.e., density) under and between the sprinklers, when they are discharging water under specified flowing (residual pressure) conditions. Water collection may be measured both with and without the presence of fire.

In addition to meeting the minimum water density requirements, it is advantageous for fire sprinklers to spray as uniform a distribution of water as possible, whether operating individually or in groups, in order to provide the same level of fire protection performance no matter where the fire starts within the protected area. This is particularly difficult to achieve for ECOH sprinklers designed for use over a range of coverage areas from 14 ft by 14 ft to 20 ft by 20 ft.

The shape of the water spray pattern directly affects the circulation of air in the vicinity of the discharging sprinkler. By shaping the deflector so that water is directed primarily radially outward in an umbrella-shaped pattern, i.e., initially generally parallel to the ceiling under which the sprinkler is located, the thrust of the water jet is directed so that air along the ceiling is entrained by the water flow and swept outward and away from the sprinkler. At the edges of the spray pattern, the air descends and circulates inward along the floor toward the center of the spray pattern where it billows up, similar to a rising cumulus cloud.

Alternatively, by shaping the deflector so that water is directed primarily downward in a more conical pattern, the thrust of the water jet is such that air is entrained by the downwardly directed water and "pulls" air in along the ceiling toward the sprinkler. This sets up a different overall circulation pattern. Depending on the intended fire protection application of the sprinkler, either spray and circulation pattern, or a combination of the patterns, may be desired, and the spray pattern of the sprinkler will be structured accordingly.

One mechanism for shaping the spray pattern, and hence the circulation pattern, is through the shape and arrangement of spaced apart tines located about the periphery of the deflector. The tines of an upright deflector, which are normally angled to face towards the outlet of the sprinkler, tend to deflect water downwardly to fill in the area beneath the sprinkler. The angle, size and shape of the tines predominantly affect the pattern of the downwardly deflected water. The water passing radially outward through the spaces or openings between the tines predominantly forms the outer portion of the spray pattern.

One of the purposes of this invention is to provide substantially improved uniformity of the water distribution pattern for sprinklers such as ECOH upright type sprinklers, thereby decreasing the variability in fire protection performance as a function of fire location, within the protected area.

The variabilities of building construction sometimes make it necessary to space sprinklers much closer together than their maximum permitted spacings, in order to provide the required degree of protection around obstructions such as columns or partitions. However, as sprinklers are brought closer together, there is an increased tendency of the spray from an operating sprinkler to impinge on an adjacent sprinkler which has not yet operated; thereby wetting the thermally responsive element of the adjacent sprinkler and preventing its proper or timely operation. If this condition, known as "cold soldering", occurs, it could lead to the fire progressing past the wetted element sprinkler, thereby increasing the damage caused by the fire. Consequently, organizations which list sprinklers include a cold soldering test in their product evaluation.

Sprinklers listed for use with a maximum standard coverage area of 130 $ft^2$ for ordinary hazard classified occupancies, as defined by NFPA 13, are required to be able to be located as close as 6 ft apart without the occurrence of cold soldering. The maximum sprinkler spacing for the 130 $ft^2$ coverage area is 10 ft by 13 ft.

In the case of an extended coverage sprinkler such as an ECOH upright type sprinkler, it is difficult to design a unit which will not result in cold soldering at a spacing as low as 9 ft yet provide the umbrella shaped water spray pattern which is necessarily high enough and wide enough to allow use of the sprinklers at a maximum spacing of 20 ft by 20 ft (i.e., coverage area of 400 $ft^2$).

An additional purpose of this invention is to provide an upright type sprinkler deflector design which is capable of providing a 20 ft by 20 ft maximum spacing coverage capability in combination with a minimum spacing capability of 9 ft without sacrifice of the desired uniformity of the spray pattern over the entire protected area.

Another concern in the development of automatic fire sprinklers is providing the water distribution performance necessary for that portion of the protected area furthest from any sprinkler. As specified in NFPA 13, sprinklers having frame arms, which is typical of the upright type, are to be installed with the plane of the sprinkler frame arms parallel to the pipe on which they are installed.

If the sprinklers are installed in a square pattern (which generally minimizes the number of sprinklers that must be installed to protect a large, relatively open space), the point centered between the four sprinklers (i.e., 45° from the plane of the frame arms) is furthest away from any of the sprinklers. The center point of this geometry is a distance of about 1.41 times one-half the sprinkler spacing away from any of the sprinklers. This is the worst case distance in terms of the "throw" necessary to ensure that sufficient water is distributed over the entire area to be protected, without spraying water too far out in other areas.

In this regard, it is also a feature of this invention to provide increased water collection in the central portion of the protected area furthest from four sprinklers, such as the ECOH upright type, installed in a square array, without sacrifice of the desired uniformity of the spray pattern over the entire protected area.

Extended coverage/ordinary hazard rated sprinklers are required to provide the same rates of water collection per unit area (i.e., density in terms of gpm/$ft^2$ (gallons per-minute/square foot) as standard coverage/ordinary hazard sprinklers, over the increased coverage area. NFPA 13 requires that sprinklers provide an average density of either 0.15 gpm/$ft^2$ or 0.20 gpm/$ft^2$ over the coverage area, depending on whether the commodity being protected is classified as Ordinary Hazard Group 1 or Ordinary Hazard Group 2, respectively, assuming a sprinkler operation design area of 1500 $ft^2$. Thus, to cover the maximum allowable standard coverage area of 130 $ft^2$ for Ordinary Hazard Group 2, a minimum flow of 26 gpm per sprinkler over the sprinkler operation design area is required. However, to cover the maximum allowable extended coverage area of 400 $ft^2$ per NFPA 13, 80 gpm is required. It is a natural and well understood principle that the much higher flow requirements for ECOH sprinklers require use of a sprinkler with a waterway larger than that commonly used for standard coverage/ordinary hazard application sprinklers.

The flow "Q" from a sprinkler expressed in U.S. gallons per minute (gpm) is determined by the formula:

$$Q=K\,(p)^{1/2}$$

where "K" represents the nominal sprinkler discharge coefficient, normally referred to as "K-factor", and "p" represents the residual (flowing) pressure at the inlet to the sprinkler in pounds per square inch (psi). In standard coverage/ordinary hazard applications, the most commonly used sprinklers have K-factors of about 5.6 (standard orifice) or 8.0 (large orifice). However, in extended coverage/ordinary hazard applications, sprinklers having K-factors of about 11.2 (extra large orifice) or 14.0 (very extra large orifice) are commonly used.

The use of the larger K-factors for ECOH applications reduces the required residual (flowing) pressure at the sprinkler inlet. This is advantageous, since generation of the higher pressure will require more power. In addition to lowering the minimum required residual (flowing) pressure over the sprinkler operation design area, the use of extra large and very extra large sprinklers provides another well understood advantage. That is, as the residual (flowing) pressure is lowered, there is an increase in the size of the water droplets created by the water stream emitted from the sprinkler orifice striking the sprinkler deflector as well as that portion of each sprinkler frame arm falling within the water stream. These larger water droplets have a higher momentum, which assists in penetration of the upward draft which can be created by a fire. In addition, the higher momentum water droplets can be deflected further from the sprinkler, as desired for extended coverage performance capability.

It is noted that using ECOH sprinklers with higher K-factors is not necessarily an advantage in all circumstances. For example, if the coverage area is 14 ft by 14 ft and the commodity is rated as Ordinary Hazard Group 1, a minimum flow of only 29.4 gpm per sprinkler is required. This would mean that the minimum required residual (flowing) pressure at the inlet of a 14.5 K-factor sprinkler would be only 4.1 psi. Use of such a low pressure could be of concern with respect to ensuring that the operating parts of the sprinkler are properly ejected when the thermally responsive element releases. This concern has been recognized by the National Fire Protection Association, and it is expected that the 1996 edition of NFPA 13 will be revised to require that all sprinkler systems be designed to operate any sprinkler at a minimum residual (flowing) pressure of 7 psi.

The features of the present invention may be used in 11.4 and 14.5 K-factor upright ECOH sprinklers. However, the advantages provided are not limited to the higher K-factor sprinklers and, for example, they could be used with nominally 5.6 or 8.0 K-factor sprinklers.

Other features and advantages of the invention will be apparent from the following description of a presently preferred embodiment, and from the claims.

DESCRIPTION OF THE PREFERRED EMBODIMENTS

Figure 2:
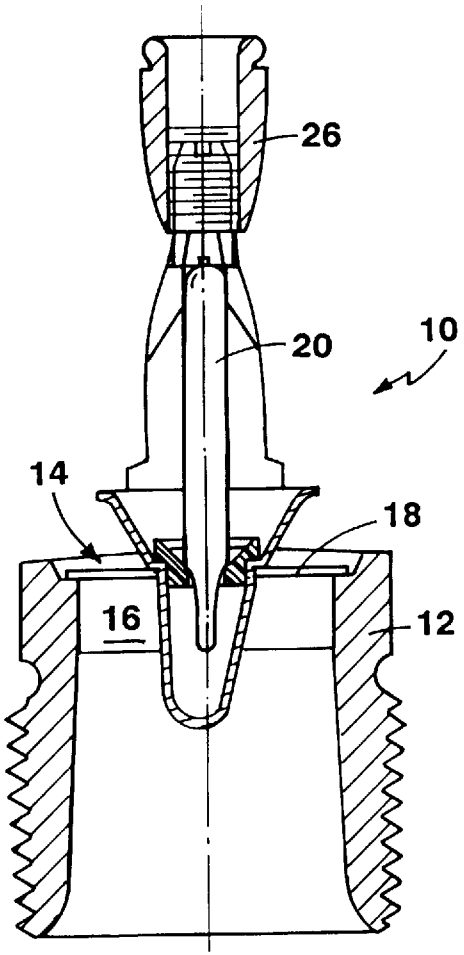
FIG. 2 is a side section view of the body of the upright fire protection sprinkler taken along the line 2—2 of FIG. 1.
Figure 1:
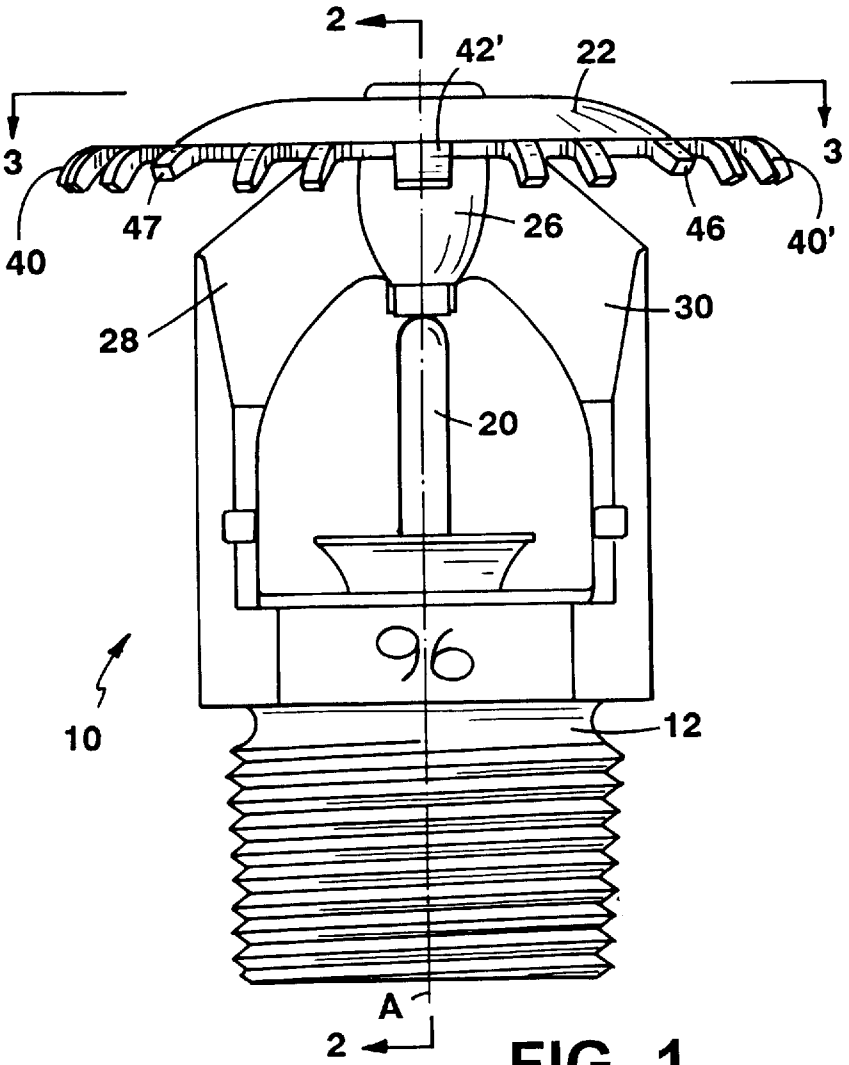
FIG. 1 is a side view of an upright fire protection sprinkler with a deflector of the invention.
Figure 3:
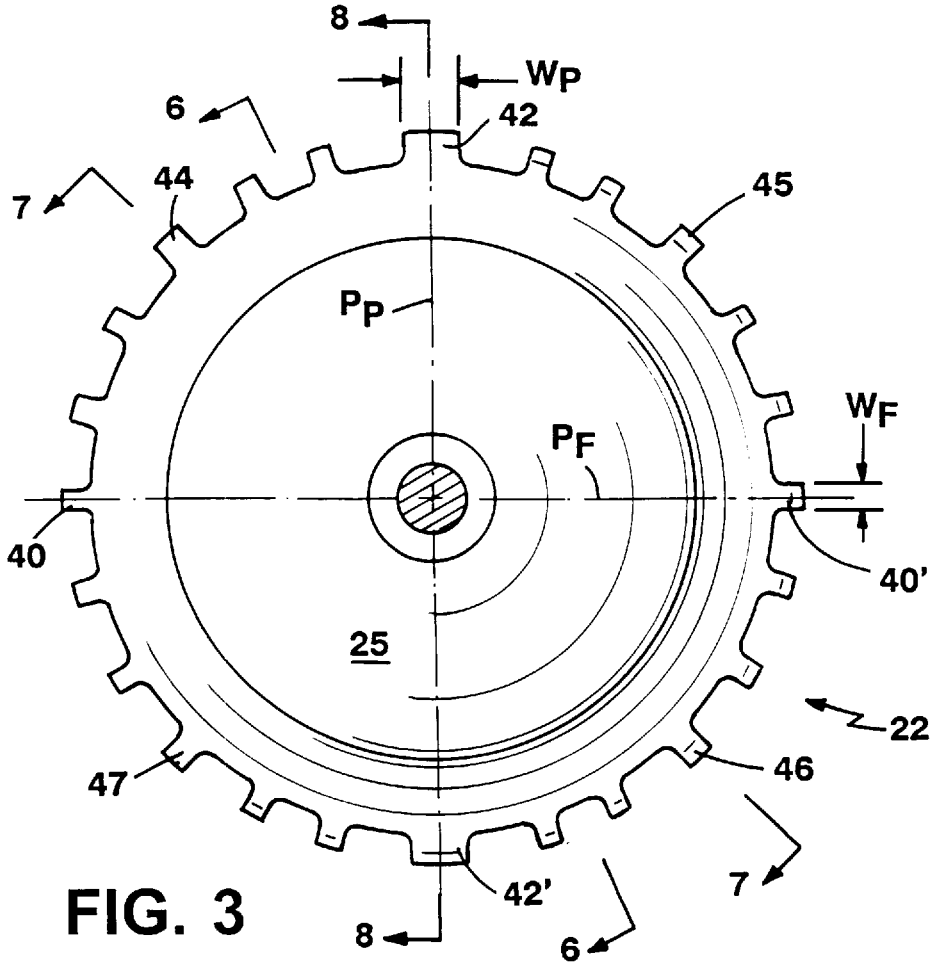
FIG. 3 is a top plan view of the deflector of the invention on the upright fire protection sprinkler, taken along the line 3—3 of FIG. 1.

Referring to FIGS. 1–3, this invention concerns a fire protection sprinkler device 10 of the upright type, including a body 12 having an outlet 14 and an orifice 16, with a releasable plug 18 normally closing the outlet and securing it in a sealed condition, a thermally responsive element 20 normally retaining the plug 18 in the closed position, and a water distribution deflector 22 facing the orifice. The orifice 16 that determines the K-factor of the sprinkler is normally located just upstream of the outlet 14. An upright type sprinkler 10 is one that is installed in such a way that the water stream discharged from the outlet 14, following release of the thermally responsive element 20, is directed upwards against a distribution plate that is normally referred to as a deflector 22, typically mounted to sprinkler mounting boss 26, supported by frame arms 28, 30. In the case of an upright type sprinkler of the standard spray variety, the deflector 22 redirects and distributes the water downward as well as outward over the area to be protected.

Figure 4:
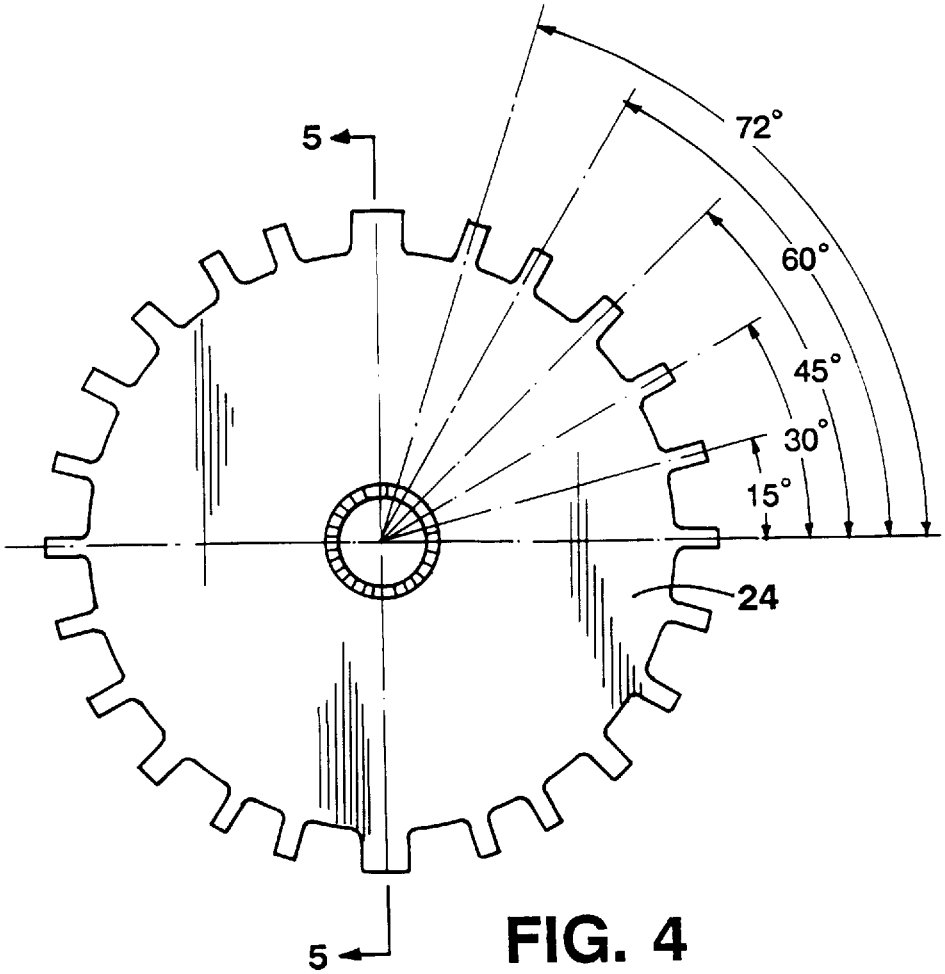
FIG. 4 is a top plan view of a blank for forming a deflector of the invention, prior to bending.
Figure 5:
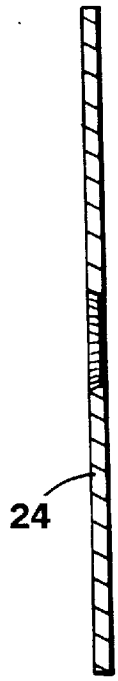
FIG. 5 is a side section view of the blank, taken along the line 5—5 of FIG. 4.
Figure 8:
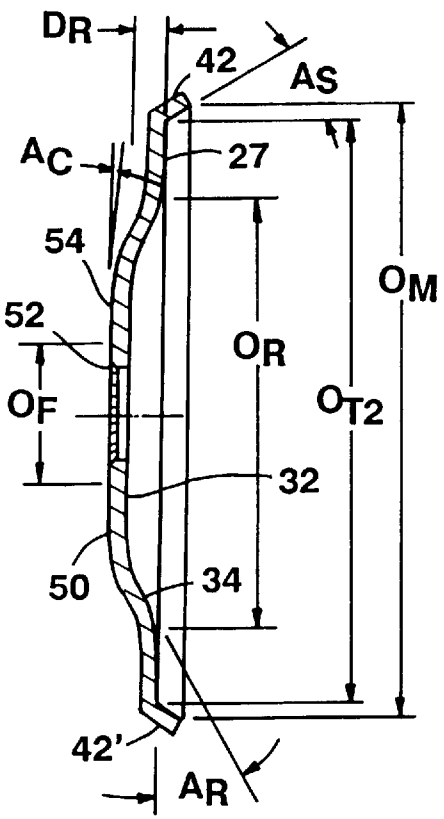
FIG. 8 is another side section view of the deflector, taken along the line 8—8 of FIG. 3.
Figure 7:
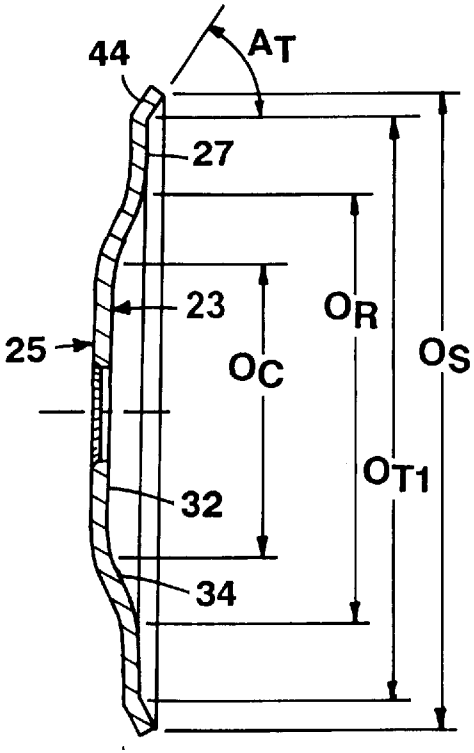
FIG. 7 is a similar side section view of the deflector, taken along the line 7—7 of FIG. 3.
Figure 6:
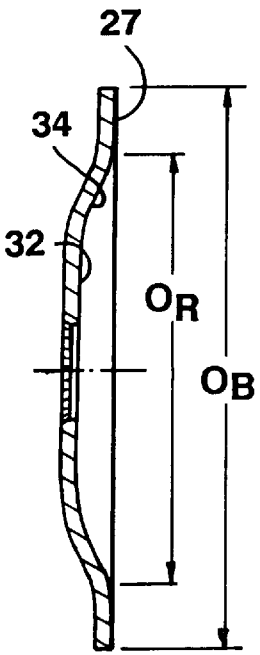
FIG. 6 is a side section view of the deflector, taken along the line 6—6 of FIG. 3.

A deflector 22 of the invention for use with 11.4 and 14.5 K-factor upright fire protection sprinklers, e.g., of the type to be sold by Grinnell Corporation, of Exeter, New Hampshire, under the Model F895 ECOH designation, is shown in FIG. 3 and in FIGS. 6–8. The deflector 22 is formed from a blank 24, shown in FIGS. 4 and 5.

Referring now also to FIGS. 6–8, the deflector 22 has an inner surface 23 opposed to flow of water from the outlet 14 and an opposite, outer surface 25. The inner surface 23 of deflector 22 defines a central area 32 that is recessed, i.e. spaced further away, from the outlet 14 relative to a radially outwardly disposed base area 27 of the deflector surface, the recessed central region 32 being disposed generally perpendicular to the axis, A, of the sprinkler body 12. A similarly recessed redirecting surface 34, essentially free of openings through to the outer surface 25 of the defector, surrounds the recessed central area 32 of the deflector 22, at a predetermined angle, $A_R$, and depth, $D_R$, thereto, where it is impinged by the water stream discharged from the sprinkler orifice 16.

The shape of the deflector 22 of the invention creates a substantially more uniform and optimized spray pattern for large (extended coverage) areas, as compared to prior art deflectors, as will now be described more fully.

Figure 9:
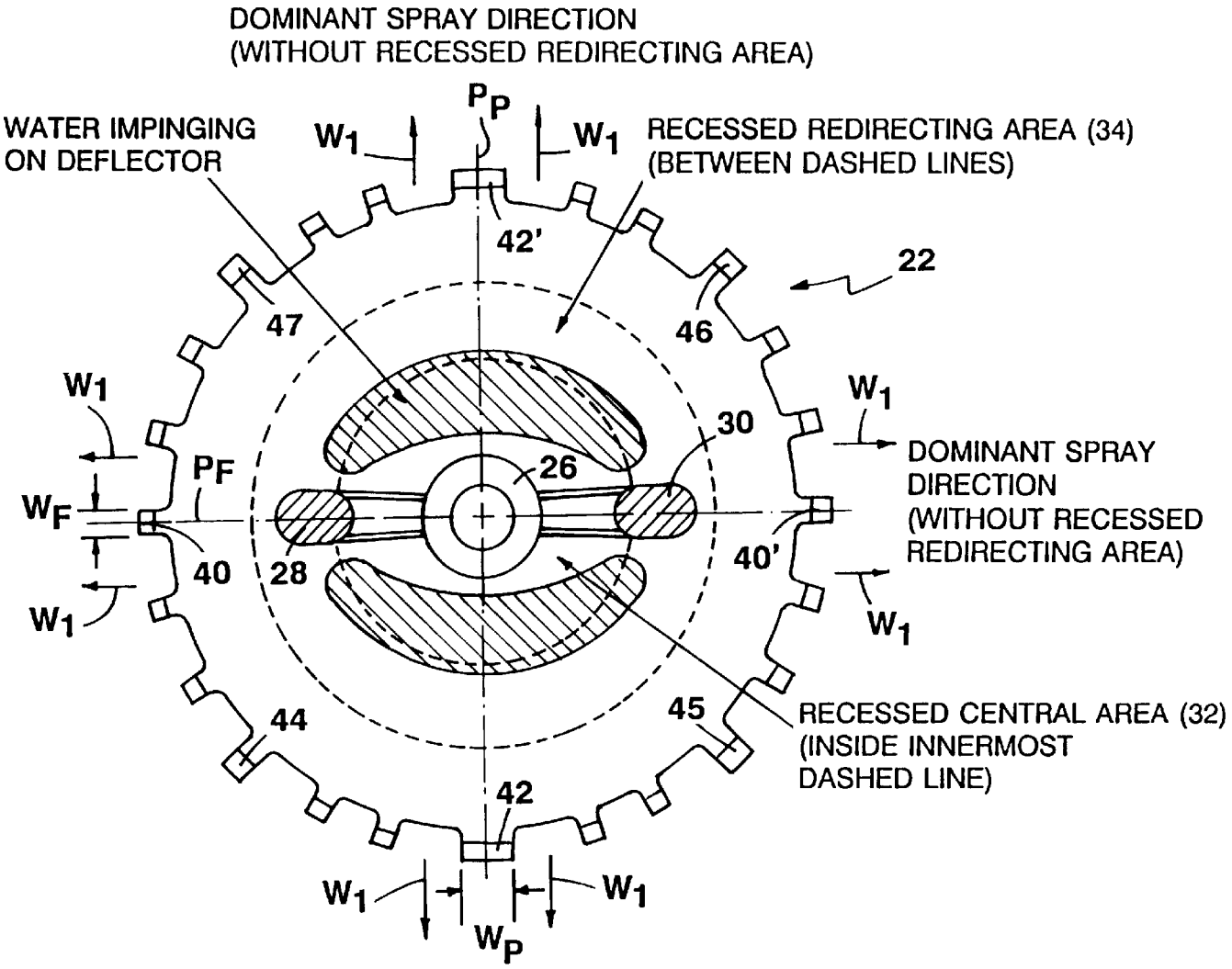
FIG. 9 is a somewhat diagrammatic plan view of the under-surface of a deflector of the invention showing spray regions.

Referring to FIGS. 1–9, when a water stream emitted from the orifice 16 and through the sprinkler outlet 14 strikes the deflector mounting boss 26 and frame arms 28, 30 attached at either side of the deflector mounting boss, the water tends to break off (separate), and then impinge on the deflector 22 in a pattern as schematically shown in FIG. 9. As a result, there tend to be stronger velocity components perpendicular to and parallel to the plane, $P_F$, of the frame arms, as shown by the direction of the arrows, $W_1$.

The effect of this non-uniform velocity profile is to produce a spray distribution pattern which is dominant (heaviest) in directions along the plane, $P_F$, of the frame arms 28, 30 and perpendicular to the plane, $P_P$. The velocity component at 45° to the plane of the frame arms tends to be somewhat weaker. This creates a particular problem for ECOH sprinklers, since this area at 45° is furthest away from the sprinkler, when installed in a square array.

To improve the uniformity of the velocity profile, the recessed redirecting surface 34 has been conceived. The recessed redirecting surface surrounds the recessed central area 32 of the deflector 22 impinged by the water stream discharged from the sprinkler orifice 16. This recessed redirecting surface 34 captures and redirects the water impinging upon it, thereby increasing the velocity component at 45° to the plane, $P_F$, of the frame arms 28, 30. The velocity components of the water spray in the directions along the plane, $P_F$, of the frame arms and in the plane, $P_P$, perpendicular thereto are, therefore, reduced. By this means, the overall uniformity of the water spray pattern over the area to be protected by the sprinkler is improved substantially.

The angle, $A_R$, of the recessed redirecting surface 34, located around the perimeter of the recessed central area 32 of the deflector, is an important aspect of providing this function. The recessed redirecting surface 34 should not be excessively vertical, because it will then direct too much of the water directly downward. In addition, a recessed redirecting surface 34 that is vertical could tend to capture one or more of the operating parts of the sprinkler 10, which might then be held by the water stream against the deflector surface, thereby obstructing portions of the water distribution pattern. The depth, $D_R$, of the recessed redirecting surface is also important. An excessively deep recessed redirecting surface 34 will tend to cause an excessive amount of water to be distributed directly beneath the sprinkler. The recessed redirecting surface 34 of the invention has an angle, $A_R$, in the range of about 10° to 45°, and preferably about 22° to 32°, relative to the horizontal, and a depth, $D_R$, in the range of about 0.030 inch to 0.210 inch, and preferably about 0.090 to 0.150 inch. In the preferred embodiment, the angle, $A_R$, of recessed redirecting surface 34 is nominally 27° relative to the horizontal, and the depth, $D_R$, is about 0.120 inch. This has been shown to function ideally for both 11.4 and 14.5 K-factor orifice ECOH upright-type sprinklers.

Another feature of the deflector 22 of the invention involves minimizing overspray from an operating sprinkler towards adjacent sprinklers. In a typical sprinkler system installation, adjacent sprinklers are located on both perpendicular axes associated with planes $P_F$, $P_P$. As a general case, experience has demonstrated that these directions are usually of primary concern in terms of water spraying onto the thermally responsive element 20 of adjacent sprinklers (i.e., cold soldering). This is of particular concern with ECOH sprinklers, since they are designed to spray further outward than ordinary hazard classified standard coverage sprinklers.

In the described invention, minimizing the possibility of overspray from an operating sprinkler 10 towards adjacent sprinklers, along the ceiling, is accomplished by specifically locating two pairs of tines, 40, 40' and 42, 42' positioned at the periphery of the deflector with inner surfaces inclined towards the outlet 14, and located respectively along the directions in line with the plane, $P_F$, of the frame arms and in the plane, $P_P$, perpendicular thereto. (Within the present state of the art, tines may or may not be positioned in these locations for commonly available upright-type sprinklers.)

According to the invention, the width of the tines 42, 42' located along the direction of the plane, $P_P$, perpendicular to the plane of the frame arms 28, 30, and inclined toward the outlet 14, have a predetermined width, $W_P$, e.g. from about 0.050 inch to 0.250 inch wide, preferably about 0.100 inch to 0.200 inch wide, and more preferably about 0.150 inch wide. Tines 42, 42' located in these positions and having the preferred width have been shown to effectively preclude overspray in the direction perpendicular to the plane of the frame arms. The tines 40, 40' located along the plane, $P_F$, of the frame arms have a relatively smaller predetermined width, $W_F$, e.g. from about 0.15 to 0.65 times, and preferably about 0.30 to 0.50 times, the width, $W_P$, of the tines 42, 42' located along the direction of the plane, $P_F$, of the frame arms. In the preferred embodiment, the predetermined width, $W_F$, is about 0.40 times the width, $W_P$, of the tines 42, 42' located along the plane, $P_F$, of the frame arms, or about 0.060 inch wide. The tines 40, 40' located in these positions cooperate with the frame arms 28, 30 to produce a spray pattern which is not sprayed excessively far out in the direction of the plane, $P_F$, of the frame arms.

Referring to FIGS. 7 and 8, another feature of the deflector 22 of the invention involves use of tines 44, 45, 46, 47 positioned at the periphery of the deflector 22 and located at 45° to the plane, $P_F$, of the frame arms. These tines provide further control for optimizing distribution of water in these critical directions. By locating tines in these positions, and by orienting them with inner surfaces inclined in a more outward direction (i.e. away from vertical) than the inner surfaces of other tines, more water can be distributed both outwardly and downwardly in these directions. (Within the present state of the art, it is customary to have all of the tines of an upright-type sprinkler deflector oriented at the same angle to vertical.) In the deflector of the invention, the inner surfaces of tines 44, 45, 46, 47 are disposed at a predetermined angle, $A_T$, further from the vertical than the predetermined angle, $A_S$, of the inner surfaces of adjacent tines. In the preferred embodiment, the angular difference from the vertical is about 10° to 45°, and preferably about 22° to 33°, and more preferably about 27°30'.

According to one preferred embodiment, the deflector blank has an outer diameter of about 2.10 inches with a diameter between tines of about 1.84 inches. After bending, the diameter, $O_M$, is about 1.92 inches, the outer diameter, $O_S$, at the tines 45° to the plane, $P_F$, of the frame arms 28, 30 is about 1.99 inches, and the diameter, $O_B$, between the tines is about 1.76 inches. The diameter, $O_{T1}$, between the bases of tines 44, 46 is about 1.84 inches and the same for the remainder of the twenty-four tines. The diameter, $O_{T2}$, between the bases of tines 42, 42' is also about 1.84 inches. The diameter, $O_C$, of the recessed central area 32 is about 0.92 inch. The outer diameter, $O_R$, of the recessed redirecting area 34 is about 1.35 inches. Tines 44, 45, 46 and 47 are about 0.074 inch wide. The remaining tines (excluding tines 40, 40' and 42, 42', discussed above) are about 0.060 inch wide. $A_T$ is 55°±3° and $A_S$ is 27°30'±1°30'. The outer surface 25 of the deflector in the region 50 of the recessed central area 32 has a flat inward region 52 having a diameter, $O_F$, e.g. about 0.44 inch, and an outward region 54 sloping towards the sprinkler outlet at an angle, $A_C$, e.g. about 2°30'±1° from the horizontal.

An outward distribution of water from the sprinkler is particularly important in the case where there is relatively little clearance between the commodity and the sprinkler deflector (as low as 18 inches is permitted by NFPA 13). (As a matter of reference, downward distribution becomes more important with greater clearance between the sprinkler deflector and commodity, in order to ensure that sufficient water is driven down into the fire plume. Thus, it is essential that both of these attributes be provided in the same sprinkler.)

With larger coverage areas, a fire centered between four sprinklers can result in a somewhat slower thermally activated release of ECOH sprinklers, as compared to sprinklers installed in accordance with standard coverage spacing requirements. This means that a fire may grow somewhat larger prior to sprinkler operation and that the associated fire plume can generate greater upward velocity, which will tend to lift the spray pattern and reduce penetration of water droplets onto the burning surfaces. Thus, if the deflector provides a predominantly outwardly directed pattern at the 45° location, the spray pattern may be lifted to the point of reducing spray effectiveness. Consequently, it is necessary for water distribution characteristics of an ECOH sprinkler to be well balanced, both downwardly and outwardly, over the area to be protected.

Figure 10:
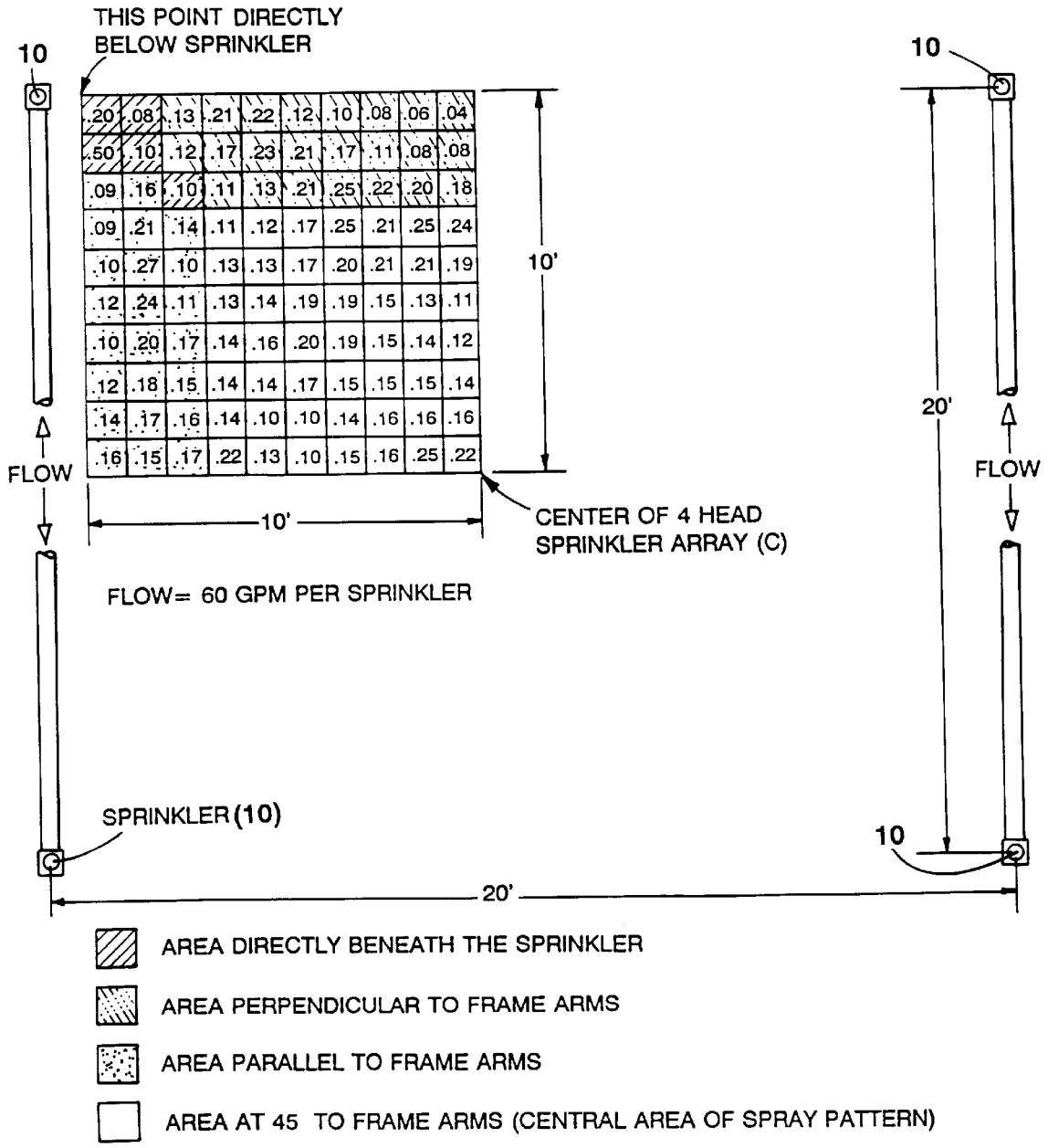
FIG. 10 shows spray densities achieved in a test of an upright fire protection sprinkler with a deflector of the invention.
Figure 11:
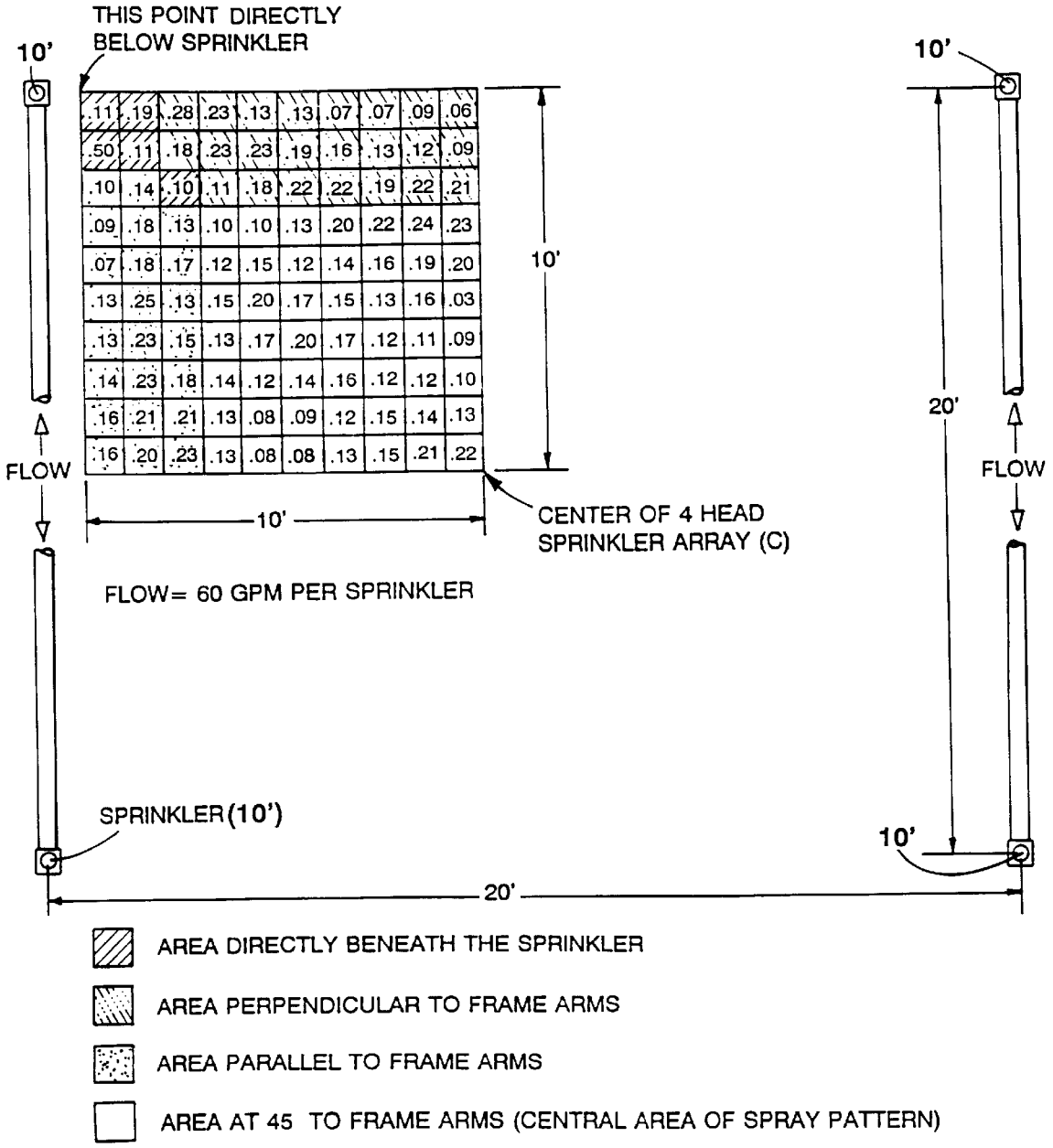
FIG. 11 shows spray densities achieved in a test of the same upright fire protection sprinkler but with a deflector which does not have the recessed central area of a deflector of this invention.

Referring now to FIGS. 10 and 11, the effect of one feature of a deflector 22 of the invention is illustrated. In particular, the recessed redirecting surface 34 changes the characteristics of the spray pattern from being dominant in directions parallel and perpendicular to the plane, $P_F$, of the frame arms 28, 30 to a pattern in which the density in the area located at 45° to the frame arms is substantially increased.

FIG. 10 represents the spray pattern for a 14.5 K-factor sprinkler with a deflector 22 of the invention. The spray density at an elevation of 3 ft below the deflector is shown. Each box represents a 1 $ft^2$ area, with the numbers indicating gallons per minute in that area. A quadrant of the pattern in a 20 ft by 20 ft area is shown. Four sprinklers 10 spaced 20 ft apart are discharging at 60 gpm with the flow to the sprinkler directed as shown in the figure. Nominal average density over the 20 ft by 20 ft area will be slightly higher than 0.15 gpm/$ft^2$ because of the tee effect. That is, water passing from the pipe through the tee and orifice tends to bend slightly towards the direction from which the water is flowing and this tends to create slight non-uniformity in the overall distribution pattern such that the area between four sprinklers receives more water than that expected if the distribution is absolutely uniform.

FIG. 11 represents the spray pattern for an identical sprinkler 10' to that represented by FIG. 10 except that the deflector is flat. Tine location, size and angles are otherwise identical. Thus the differences in the distribution patterns between FIG. 10 and FIG. 11 are due to the recessed redirecting surface 34 of the deflector represented by FIG. 10. In FIG. 10, note that the average spray density of 0.163 gpm/$ft^2$ in the area at 45° to the frame arms is about 12% higher than that of 0.145 gpm/$ft^2$ for the equivalent area in FIG. 11. Thus, water from the areas perpendicular and parallel to the frame arms has been redirected towards the central area of the pattern between four sprinklers.

It is noted that UL requires that the central area, C, of the pattern must average 0.150 gpm/ft$^2$ when tested in the configuration of FIGS. 10 and 11. Thus while the deflector 22 with the redirecting surface 34 easily meets the UL requirement, the flat deflector fails to meet the required average.

It is noted that UL also conducts so-called 350 pound wood crib fire tests with 7 foot, 6 inches of clearance between the sprinkler deflector and the top surface of the wood crib. In this test, an n-heptane fuel burner is located underneath the wood crib and provides a fire of approximately 2 megawatts which generates a strong upward plume. These tests are conducted between four sprinklers spaced in accordance with each coverage area for which the sprinkler is to be UL Listed. The performance of the ECOH upright-type sprinklers of the present invention was exceptionally good in all of these test scenarios.

Other embodiments of the invention are within the scope of the following claims.

What is claimed is:

1. An upright fire protection sprinkler comprising a body defining an orifice and outlet for flow of fluid from a source, said outlet having an axis, and a deflector disposed generally coaxial with said outlet and positioned for impingement of the flow of fluid thereupon, said deflector defining an inner surface opposed to water flow from said outlet and positioned for impingement of flow of fluid thereupon, and an opposite outer surface, said inner surface defining:

a generally planar central area about said axis, a redirecting area extending about the periphery of said central area at a predetermined acute angle and predetermined axial offset thereto, relative to the horizontal, said redirecting area being free of through openings from said inner surface of said deflector to said opposite outer surface, and a base area radially outward of and extending about the periphery of said redirecting area, at least an inner region of said base area being free of through openings, said central area and said redirecting area being recessed from said outlet relative to said base area, said base area lying in a plane perpendicular to said axis.

2. The upright fire protection sprinkler of claim 1 wherein said predetermined acute angle is between about 10° to 45°.

3. The upright fire protection sprinkler of claim 2 wherein said predetermined acute angle is between about 22° to 32°.

4. The upright fire protection sprinkler of claim 3 wherein said predetermined acute angle is about 27°.

5. The upright fire protection sprinkler of claim 1 wherein said predetermined axial offset of said redirecting area, relative to the horizontal, as measured between intersections of said redirecting area with said central area and said base area, is between about 0.030 inch and 0.210 inch.

6. The upright fire protection sprinkler of claim 5 wherein said predetermined axial offset is between about 0.090 inch and 0.150 inch.

7. The upright fire protection sprinkler of claim 6 wherein said predetermined axial offset is about 0.120 inch.

8. The upright fire protection sprinkler of claim 1 further comprising a pair of frame arms extending from said body and disposed generally in a first plane including said axis, with said deflector mounted thereupon, said deflector further comprising a plurality of tines defining inner tine surfaces inclined, relative to the horizontal, towards said outlets, said plurality of tines comprising at least a first set of tines and a second set of tines.

9. The upright fire protection sprinkler of claim 8 wherein said first set of tines are disposed in planes at about 45° to said first plane and including said axis, said inner tine surfaces of said first set of tines being inclined at a first predetermined angle from the horizontal, and, adjacent to said first set of tines, said plurality of tines further comprises tines having said inner tine surfaces inclined at a second predetermined angle from the horizontal, said first predetermined angle being relatively more outward from said axis than said second predetermined angle.

10. The upright fire protection sprinkler of claim 9 wherein said first predetermined angle is between about 10° to 45° further from the vertical than said second predetermined angle.

11. The upright fire protection sprinkler of claim 10 wherein said first predetermined angle is between about 22° to 33° further from the vertical than said second predetermined angle.

12. The upright fire protection sprinkler of claim 11 wherein said first predetermined angle is about 27°30' further from the vertical than said second predetermined angle.

13. The upright fire protection sprinkler of claim 8 wherein a second set of tines generally in a plane perpendicular to said first plane have a predetermined second set width and a third set of tines in said first plane including said frame arms has a predetermined third set width, said predetermined third set width being about 0.15 to 0.65 times said predetermined second set width.

14. The upright fire protection sprinkler of claim 13 wherein said predetermined third set width is about 0.30 to 0.50 times said predetermined second set width.

15. The upright fire protection sprinkler of claim 14 wherein said predetermined third set width is about 0.40 times said predetermined second set width.

16. The upright fire protection sprinkler of claim 15 wherein said predetermined second set width is about 0.150 inch and said predetermined third set width is about 0.060 inch.

17. The upright fire protection sprinkler of claim 8 wherein said second set of tines are disposed generally in a plane perpendicular to said first plane and including said axis, said inner tine surfaces of said second set of tines having a predetermined second set width, said predetermined second width being substantially greater than widths of said inner tine surfaces of all other tines of said plurality of tines.

18. The upright fire protection sprinkler of claim 17, wherein said predetermined second width is about 0.150 inch.

19. An upright fire protection sprinkler comprising:

a body defining an orifice and outlet for flow of fluid from a source, said outlet having an axis, a deflector disposed generally coaxial with said outlet and positioned for impingement of the flow of fluid thereupon, and a pair of frame arms extending from said body and disposed generally in a first plane including said axis, with said deflector mounted thereupon, said deflector comprising a plurality of tines defining inner tine surfaces inclined from the horizontal towards said outlet, said plurality of tines comprising at least a first set of tines, said first set of tines being disposed in planes at about 45° to said first plane and including said axis, said inner tine surfaces of said first set of tines being inclined at a first predetermined angle from the horizontal, and, adjacent to said first set of tines, said plurality of tines further comprises tines having said inner tine surfaces inclined at a second predetermined angle from the horizontal, said first predetermined angle being relatively more outward from said axis than said second predetermined angle.

20. The upright fire protection sprinkler of claim 19 wherein said first predetermined angle is between about 10° to 45° further from the vertical than said second predetermined angle.

21. The upright fire protection sprinkler of claim 20 wherein said first predetermined angle is between about 22° to 33° further from the vertical than said second predetermined angle.

22. The upright fire protection sprinkler of claim 21 wherein said first predetermined angle is about 27°30' further from the vertical than said second predetermined angle.

23. The upright fire protection sprinkler of claim 19, 20, 21 or 22 wherein said deflector further defines an inner surface opposed to water flow from said outlet and positioned for impingement of flow of fluid thereupon, and an opposite outer surface, said inner surface defining:

a generally planar central area about said axis, a redirecting area extending about the periphery of said central area at a predetermined acute angle and predetermined axial offset thereto, relative to the horizontal, said redirecting area being free of through openings from said inner surface of said deflector to said opposite outer surface, and a base area radially outward of and extending about the periphery of said redirecting area, at least an inner region of said base area being free of through openings, said central area and said redirecting area being recessed from said outlet relative to said base area.

24. An upright fire protection sprinkler comprising:

a body defining an orifice and outlet for flow of fluid from a source, said outlet having an axis, a deflector disposed generally coaxial with said outlet and positioned for impingement of the flow of fluid thereupon, and a pair of frame arms extending from said body and disposed generally in a first plane including said axis, with said deflector mounted thereupon, said deflector comprising a plurality of tines defining inner tine surfaces inclined from the horizontal towards said outlet, said plurality of tines comprising at least a first set of tines, a second set of tines, and a third set of tines, said second set of tines being disposed generally in a plane perpendicular to said first plane and including said axis, and said third set of tines being disposed in said first plane including said frame arms, said inner tine surfaces of said second set of tines having a predetermined second set width extending across said plane perpendicular to said first plane and including said axis, and said inner tine surfaces of said third set of tines having a predetermined third set width, said predetermined third set width being about 0.15 to 0.65 times said predetermined second set width.

25. The upright fire protection sprinkler of claim 24 wherein said predetermined third set width is about 0.30 to 0.50 times said predetermined second set width.

26. The upright fire protection sprinkler of claim 25 wherein said predetermined third set width is about 0.40 times said predetermined second set width.

27. The upright fire protection sprinkler of claim 26 wherein said predetermined second set width is about 0.150 inch and said predetermined third set width is about 0.060 inch.

28. The upright fire protection sprinkler of claim 24, 25, 26 or 27 wherein said deflector further defines an inner surface opposed to water flow from said outlet and positioned for impingement of flow of fluid thereupon, and an opposite outer surface, said inner surface defining:

a generally planar central area about said axis, a redirecting area extending about the periphery of said central area at a predetermined acute angle and predetermined axial offset thereto, relative to the horizontal, said redirecting area being free of through openings from said inner surface of said deflector to said opposite outer surface, and a base area radially outward of and extending about the periphery of said redirecting area, at least an inner region of said base area being free of through openings, said central area and said redirecting area being recessed from said outlet relative to said base area.

29. An upright fire protection sprinkler comprising:

a body defining an orifice and outlet for flow of fluid from a source, said outlet having an axis, a deflector disposed generally coaxial with said outlet and positioned for impingement of the flow of fluid thereupon, and a pair of frame arms extending from said body and disposed generally in a first plane including said axis, with said deflector mounted thereupon, said deflector comprising a plurality of tines defining inner tine surfaces inclined from the horizontal towards said outlet, said plurality of tines comprising at least a first set of tines and a second set of tines, said second set of tines being disposed generally in a plane perpendicular to said first plane and including said axis, said inner tine surfaces of said second set of tines having a predetermined second set width extending across said plane perpendicular to said first plane and including said axis, said predetermined second set width being substantially greater than widths of said inner tine surfaces of all other tines of said plurality of tines.

30. The upright fire protection sprinkler of claim 29, wherein said predetermined second width is about 0.150 inch.

31. The upright fire protection sprinkler of claim 29 or 30 wherein said deflector further defines an inner surface opposed to water flow from said outlet and positioned for impingement of flow of fluid thereupon, and an opposite outer surface, said inner surface defining:

a generally planar central area about said axis, a redirecting area extending about the periphery of said central area at a predetermined acute angle and predetermined axial offset thereto, relative to the horizontal, said redirecting area being free of through openings from said inner surface of said deflector to said opposite outer surface, and a base area radially outward of and extending about the periphery of said redirecting area, at least an inner region of said base area being free of through openings, said central area and said redirecting area being recessed from said outlet relative to said base area.

32. The upright fire protection sprinkler of claim 1, 19, 24, or 29, wherein said sprinkler has a K-factor of at least 5.0.

33. The upright fire protection sprinkler of claim 32, wherein said sprinkler has a K-factor of at least 7.0.

34. The upright fire protection sprinkler of claim 33, wherein said sprinkler has a K-factor of at least 10.5.

35. The upright fire protection sprinkler of claim 34, wherein said sprinkler has a K-factor of at least 13.0.

* * * * *